US008276371B2

(12) United States Patent
Wei

(10) Patent No.: US 8,276,371 B2
(45) Date of Patent: Oct. 2, 2012

(54) EXHAUST SYSTEM HAVING EXHAUST SYSTEM SEGMENT WITH IMPROVED CATALYST DISTRIBUTION AND METHOD

(75) Inventor: Zhiyong Wei, Chicago, IL (US)

(73) Assignee: Caterpillar Inc., Peoria, IL (US)

( * ) Notice: Subject to any disclaimer, the term of this patent is extended or adjusted under 35 U.S.C. 154(b) by 857 days.

(21) Appl. No.: 12/157,143

(22) Filed: Jun. 6, 2008

(65) Prior Publication Data

US 2009/0301065 A1 Dec. 10, 2009

(51) Int. Cl.
*F01N 3/035* (2006.01)

(52) U.S. Cl. ..... 60/295; 60/297; 60/301

(58) Field of Classification Search ..... 60/295, 60/297, 311, 301
See application file for complete search history.

(56) References Cited

U.S. PATENT DOCUMENTS 5,089,237 A * 2/1992 Schuster et al. ..... 422/180
6,805,849 B1 10/2004 Andreasson et al.
6,826,906 B2 12/2004 Kakwani et al.
7,062,904 B1 6/2006 Hu et al.
7,143,578 B2 12/2006 Kakwani et al.
7,229,597 B2 6/2007 Patchett et al.
2006/0153761 A1* 7/2006 Bandl-Konrad et al. .. 423/239.1
2007/0240406 A1* 10/2007 Zhang et al. ..... 60/297
2008/0127638 A1* 6/2008 Vaarkamp et al. ..... 60/297
2008/0141661 A1* 6/2008 Voss et al. ..... 60/295

* cited by examiner

*Primary Examiner* — Thomas Denion
*Assistant Examiner* — Jonathan Matthias
(74) *Attorney, Agent, or Firm* — Liell & McNeil

(57) ABSTRACT

An exhaust system for an internal combustion engine includes an upstream segment and a downstream segment connecting with the upstream segment. The downstream segment is a NOx reducing segment having an exhaust gas outlet and a reductant inlet disposed between the exhaust gas outlet and an exhaust gas inlet for the downstream segment. The upstream segment further includes a coating having a catalyst configured to increase a ratio of $NO_2$ to NO in exhaust gases passing through the upstream segment. The coating includes a catalyst distribution, which may be a catalyst coating length, which is linked to a target ratio of $NO_2$ to NO for reducing NOx in the downstream segment. The catalyst distribution in the upstream segment is adapted to increase the ratio of $NO_2$ to NO, while limiting the ratio of $NO_2$ to NO to a ratio optimized for reduction of NOx in the downstream segment.

6 Claims, 2 Drawing Sheets

EXHAUST SYSTEM HAVING EXHAUST SYSTEM SEGMENT WITH IMPROVED CATALYST DISTRIBUTION AND METHOD

TECHNICAL FIELD

The present disclosure relates generally to aftertreatment systems for internal combustion engines, and relates more particularly to distributing a catalyst in an upstream exhaust system segment to improve reduction of nitrogen oxides in a downstream exhaust system segment.

BACKGROUND

Internal combustion engines tend to generate a variety of exhaust emissions during operation. Aftertreatment systems are used with most modern internal combustion engines to eliminate or reduce certain of these emissions. Over the years, many different aftertreatment strategies have been proposed for reducing or eliminating emissions such as particulates, unburned hydrocarbons and nitrogen oxides of various types, collectively referred to as "NOx." Particulate filters, catalytic converters and other devices are familiar examples of aftertreatment components directed to emissions reduction. Aftertreatment components include devices which are adapted to store or "trap" emissions, and devices which convert certain emissions into other materials considered less harmful or more manageable, as well as systems which do both.

A device commonly known as a diesel particulate filter is often used in connection with compression ignition diesel engines to trap particulates at a location downstream from the engine, rather than releasing the particulates via the tailpipe or exhaust stack. While diesel particulate filters have been demonstrated to be effective in reducing the release of undesired particulates in exhaust, over time the filter tends to become clogged. As the filter becomes progressively more clogged, it can create undesired backpressure in the exhaust system and become less effective. Most engines equipped with a particulate filter are also equipped with some means for burning off or "regenerating" the particulates trapped in the filter. One conventional strategy for filter regeneration is to induce combustion of the accumulated particulates, cleaning the filter. "Active" regeneration techniques for initiating combustion of accumulated particulates include injection of additional fuel into the exhaust system itself, heating the filter via electric heaters and the like and other strategies such as operating the engine via post injections to raise exhaust temperatures to temperatures sufficient to initiate combustion of the accumulated particulates.

While the previously mentioned regeneration strategies have seen success, they tend to require additional hardware and/or energy to operate. An alternative regeneration strategy is known in the art as continuous regeneration, and typically utilizes a catalyst positioned within the exhaust system at a location upstream from a particulate filter. Such catalysts may be used to chemically convert certain exhaust constituents into different chemical compounds which are capable of passively inducing regeneration of the accumulated particulates. In one common example, a diesel oxidation catalyst which includes platinum is positioned within the exhaust stream at a location upstream from a diesel particulate filter. As exhaust gases pass through the diesel oxidation catalyst, nitrogen oxide or "NO" in the exhaust gases may be converted to nitrogen dioxide or "$NO_2$", which in turn oxidizes particulate matter trapped in the particulate filter.

Engineers have developed various strategies for varying the catalyst loading density and uniformity within passively regenerated systems to result in optimal particulate matter oxidation. Other known strategies place catalysts on the diesel particulate filter itself, such that NO in the exhaust gases is continuously converted to $NO_2$ as the exhaust gases pass through the filter, ostensibly providing a continuous supply of $NO_2$ for continuous oxidation of accumulated particulate matter. Such systems have proven applicable in certain environments, but they are not without problems. While diesel oxidation catalysts may be effectively used to oxidize accumulated particulates for filter regeneration, $NO_2$ may be generated in excess, potentially creating problems with other components of the aftertreatment system positioned downstream.

U.S. Pat. No. 6,805,849 to Andreasson et al. is directed to one type of exhaust aftertreatment system adapted to adjust an $NO_2$ to NO ratio to purportedly improve NOx reduction. In particular, Andreasson et al. propose an improved SCR catalyst system adapted to supply exhaust gas at a particular $NO_2$ to NO ratio to improve NOx reduction. A shortcoming of the design proposed by Andreasson et al. is that a relatively bulky and expensive diesel oxidation catalyst and associated apparatus appears to be required.

SUMMARY

In one aspect, a method of treating exhaust gases in an exhaust system of an internal combustion engine includes a step of receiving exhaust gases from the internal combustion engine at a ratio of $NO_2$ to NO. The method further includes a step of increasing the ratio of $NO_2$ to NO via a catalyst within an upstream segment of the exhaust system toward a target ratio for reducing NOx in a downstream segment of the exhaust system, and limiting increasing the ratio of $NO_2$ to NO within the upstream segment via a distribution of the catalyst in the upstream segment, which is linked to the target ratio. The method still further includes a step of reducing NOx in the exhaust gases within a downstream segment of the exhaust system.

In another aspect, an exhaust system for an internal combustion engine includes an upstream segment having an exhaust inlet and an exhaust outlet, and a downstream segment. The downstream segment has an exhaust inlet connecting with the exhaust outlet of the upstream segment, the downstream segment including a NOx reducing segment having an exhaust gas outlet for discharging exhaust gases and a reductant inlet disposed between the corresponding exhaust gas inlet and exhaust gas outlet for injecting a reductant into the downstream segment to reduce NOx in exhaust gases passing therethrough. The upstream segment further includes a coating which includes a catalyst configured to increase a ratio of $NO_2$ to NO in exhaust gases passing between the exhaust inlet and the exhaust outlet of the upstream segment. The coating includes a catalyst distribution which is linked to a target ratio of $NO_2$ to NO for reducing NOx in the downstream segment.

In still another aspect, an exhaust system segment for an internal combustion engine includes a particulate filter for filtering particulates from exhaust gases passing through the exhaust system segment. The particulate filter includes a housing having an exhaust inlet, an exhaust outlet and a filter element disposed within the housing. The exhaust system segment further includes means, including a catalyst, for increasing a ration of $NO_2$ to NO in exhaust gases passing from the exhaust inlet to the exhaust outlet, and for limiting increasing the ratio of $NO_2$ to NO based on a target ratio for reducing exhaust gases in a second exhaust system segment positioned downstream the particulate filter.

DETAILED DESCRIPTION

Figure 1:
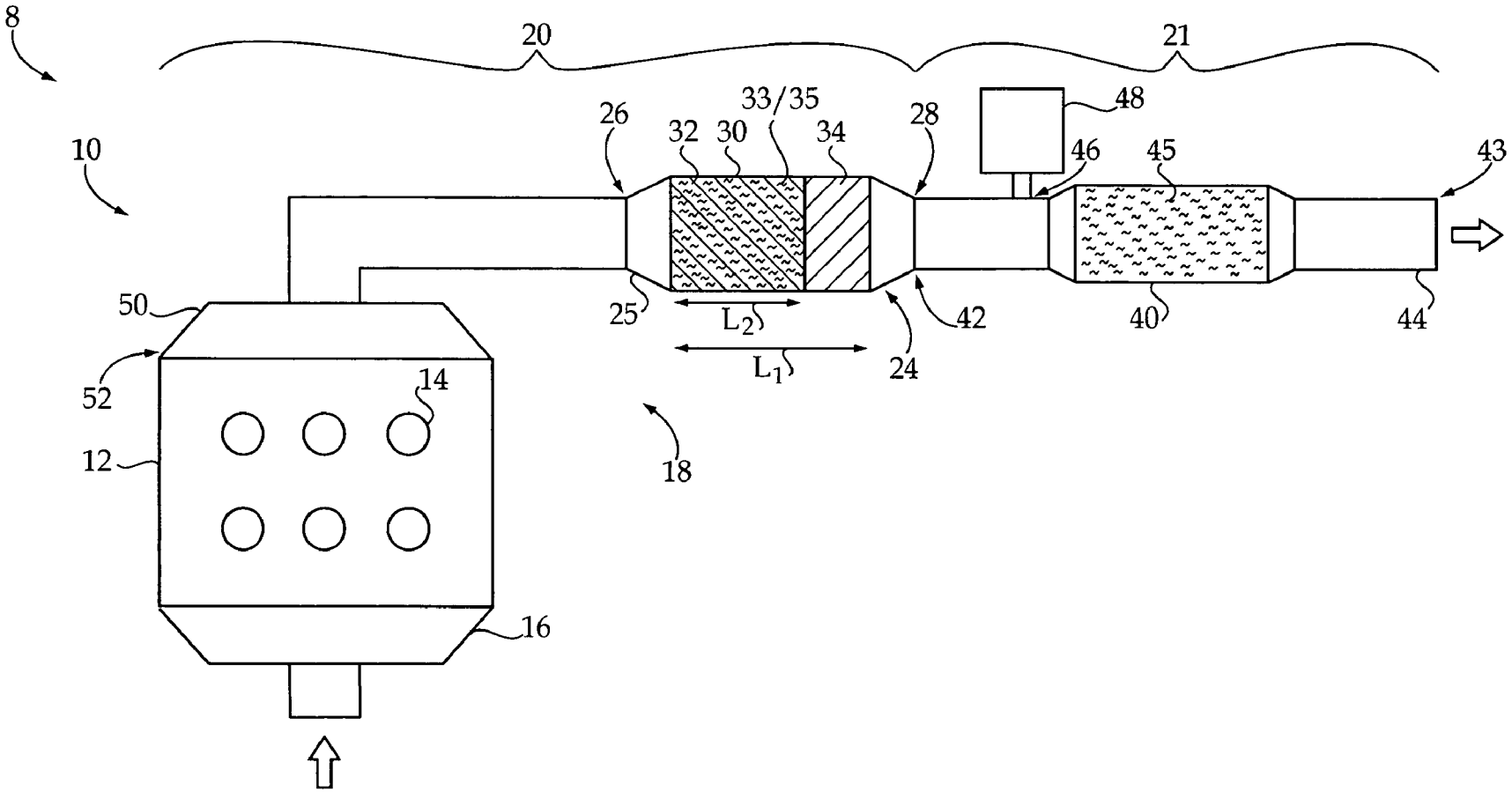
FIG. 1 is a side diagrammatic view of an engine according to one embodiment.

Referring to FIG. 1, there is shown an engine system 8 including an engine 10 according to one embodiment. Engine 10 may be a compression ignition diesel engine, but might be a different engine type in other embodiments. Engine 10 may include an engine housing 12 having at least one cylinder 14 therein, and typically being a multi-cylinder direct injection diesel engine. Engine 10 may further include an intake manifold 16 for supplying combustion air to cylinders 14, and an exhaust manifold 50 to which exhaust gases are passed from cylinders 14. An exhaust inlet 52 may fluidly connect exhaust manifold 50 with engine housing 12. In one embodiment, exhaust manifold 50 may be part of an upstream segment 20 of an exhaust system 18 of engine system 8. Exhaust inlet 52 may thus serve as an exhaust inlet to upstream segment 20. Upstream segment 20 may further have an exhaust outlet 28 downstream of exhaust inlet 52. Exhaust system 18 may have a downstream segment 21 with an exhaust inlet 42 connecting with exhaust outlet 28 of upstream segment 20. Downstream segment 21 may further include an exhaust outlet 43, for example an outlet of a tailpipe or exhaust stack 44, from which exhaust gases are expelled after-treating the exhaust gases in exhaust system 18.

Exhaust system 18 may include a plurality of aftertreatment elements which are adapted to remove or reduce certain emissions in exhaust gases passing therethrough. In one embodiment, a particulate filter 24 may be disposed in upstream segment 20, and a NOx reducing element 40 may be disposed in downstream segment 21. NOx reducing element 40 may include a selective catalytic reduction device adapted to reduce NOx in the presence of a catalyst, a variety of which are known and commercially available. To this end, downstream segment 21 may also include a reductant inlet 48 which is configured to enable injection of a reductant from a reductant supply 48 into exhaust gases passing through downstream segment 21. In one embodiment, reductant supply 48 may include a supply of urea which is injected via inlet 46 at a location upstream of NOx reducing element 40. Downstream segment 21 may also include a catalyst 45, such as a Fe-zeolite SCR catalyst, to assist in reducing NOx therein. Depending upon the type of reductant used, compressed air might also be supplied and injected via reductant inlet 46, or via another inlet, into exhaust system 18. Particulate filter 24 may include an exhaust inlet 26 in a housing 25, and an exhaust outlet 28, also in housing 25. It will be noted that exhaust outlet 28 of filter 24 may also be the exhaust outlet of upstream segment 20, and is therefore commonly labeled therewith. Particulate filter 24 may further include a filter element 30 disposed within housing 25 which is configured to filter particulates from exhaust gases passing between exhaust inlet 26 and exhaust outlet 28.

In one embodiment, filter element 30 may be a coated filter, such as a ceramic filter or a fibrous metallic filter, having a coating 35 which includes a catalyst 33. Catalyst 33 may include an oxidation catalyst which is configured to increase a ratio of $NO_2$ to NO within upstream segment 20 toward a target ratio for reducing NOx in downstream segment 21. Catalyst 33 may further have a distribution in upstream segment 20 such that it limits the increase in the ratio of $NO_2$ to NO, inhibiting increasing the ratio of $NO_2$ to NO above the target ratio for reducing NOx in downstream segment 21.

The distribution of catalyst 33 in upstream segment 20 may be a function of certain characteristics of the coating 35 of which catalyst 33 is apart. One or more of coating length, catalyst loading density in coating 35, or a catalyst loading profile may be specified such that exhaust gases passing through particulate filter 24 are treated appropriately to oxidize NO to $NO_2$, for initiating combustion of particulate matter trapped in filter element 30, while outputting exhaust gases having a desired ratio of $NO_2$ to NO. Application methods for applying catalyst coatings to diesel particulate filters are known in the art. Techniques are also known in the art for varying catalyst coating length, catalyst loading density, and catalyst loading profile. One practical implementation strategy is considered to be coating filter element 30 via coating 35 to provide uniform catalyst loading density over a specified length of filter element 30. To this end, filter element 30 may include a coated section 32 and a bare section 34. Filter element 30 may thus be non-uniformly coated with coating 35, such that catalyst 33 is non-uniformly distributed on filter 30, although coating 35 may itself be uniform with respect to catalyst loading density, coating thickness, etc.

Figure 2:
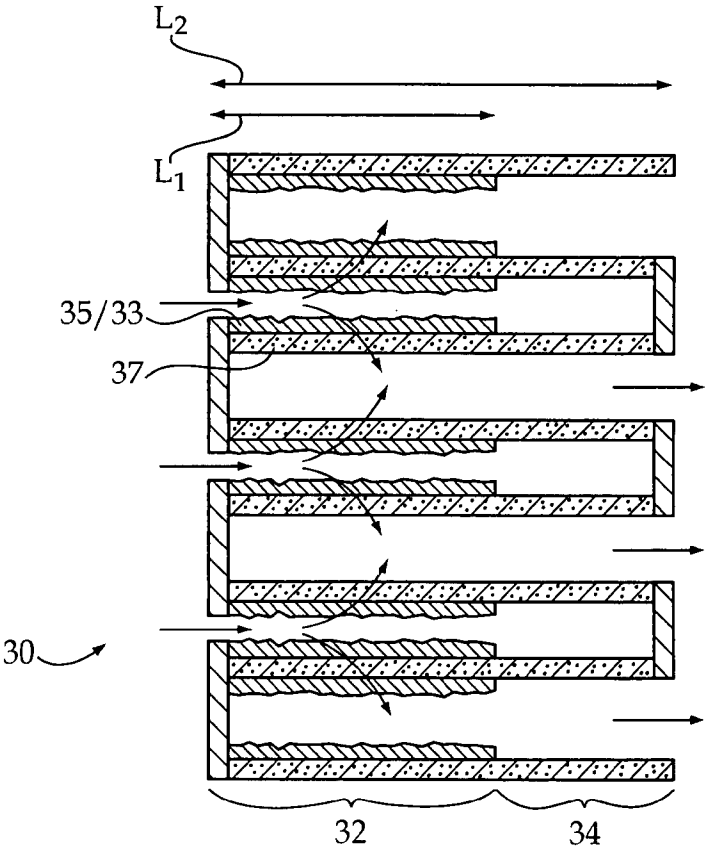
FIG. 2 is a sectioned side view through a portion of an exhaust system segment, according to one embodiment.

Coated section 32 may have a length $L_2$, whereas filter element 30 may have another length $L_1$ which is greater than length $L_2$ and includes the respective lengths of both of sections 32 and 34. Coated section 32 may be positioned upstream bare section 34 in a practical implementation strategy. The relative length of coated section 32 versus bare section 34 may define a catalyst distribution in upstream segment 20. Where density of catalyst 33 is uniform in coating 35, length $L_2$ may define a catalyst loading profile in upstream segment 20. Catalyst distribution in upstream segment 20 may be linked to the target ratio of $NO_2$ to NO. In other words, length $L_2$ may be a length which is tailored to limit increasing the $NO_2$ to No ratio above the target ratio. A relatively greater length $L_2$ would be expected to result in a relatively greater $NO_2$ to NO ratio, and vice versa. Catalyst 33 might be or include platinum, or a variety of other known oxidation catalysts. Referring also to FIG. 2, there is shown a sectioned side view of filter element 30, including coated section 32 and bare section 34. A filter substrate 37 is provided, such as a monolithic ceramic filter substrate. In other embodiments, a plurality of filter cartridges might be used, or potentially non-ceramic materials. Coating 35, which includes catalyst 33, may be supported on substrate 37. Filter element 30 is shown having a wall-flow honeycomb configuration in FIG. 2, however, the present disclosure is not thereby limited. FIG. 2 illustrates one example embodiment where catalyst loading profile is defined by length $L_2$, the length of coating 35. In other words, coating length, for a uniform coating, defines the loading profile. If, for example, section 34 had a coating containing a catalyst but at a different loading density than that of coating 35, then catalyst loading density could define at least in part the catalyst loading profile. It is contemplated that zone-coating, i.e. coating only a certain zone of filter substrate 37, will be a practical implementation strategy, however.

Exhaust gases passing through downstream segment 21 may be treated by reducing NOx in the exhaust gases while passing through downstream segment 21. It has been discovered that reducing NOx may take place via a plurality of reaction pathways, which may be selectively promoted and/or inhibited. By providing exhaust gases at or close to the target ratio described herein to downstream segment 21, a faster one of the plurality of different reaction pathways may be promoted. In other words, by selecting an appropriate catalyst distribution for upstream segment 20, and in particular for particulate filter 24, a faster reaction pathway may be promoted as compared to a plurality of other reaction pathways. In one embodiment, the ratio of $NO_2$ to NO which is present in the exhaust gases passing from upstream segment 20 to downstream segment 21 may be limited to a ratio which is about 1:1. It has been further discovered that providing a ratio of $NO_2$ to NO which is about 1:1 will tend to promote the relatively fast reaction pathway: 2 mol $NO_2$+2 mol NO+4 mol $NH_3$(ads)→$4N_2$+$6H_2O$. A plurality of other, relatively slow $NO_X$ reducing reaction pathways which may be 10-100 times slower than the relatively fast reaction pathway may take place simultaneously. However, relatively less $NO_x$ reduction will tend to take place via the relatively slow reaction pathways than the relatively faster reaction pathway set forth above, when filter 24 is configured as described herein.

INDUSTRIAL APPLICABILITY

Operation of engine system 8 will typically be initiated by starting engine 10, such that combustion air is drawn into intake manifold 16 and supplied to cylinders 14 where it is combusted with a fuel such as a diesel fuel. Exhaust gases from the combustion of fuel and air in cylinders 14 may then be passed via inlet 52 into exhaust manifold 50, and thenceforth passed to particulate filter 24. It should be appreciated that a turbine of a turbocharger might be positioned fluidly between exhaust manifold 50 and particulate filter 24 in a conventional manner. It should be noted, however, that upstream segment 20 will typically be free from catalysts between exhaust manifold 50 and particulate filter 24. Many earlier strategies, such as Andreasson et al., described above, utilize a diesel oxidation catalyst which is positioned in a housing between an exhaust manifold and a particulate filter.

Exhaust gases from exhaust manifold 50 will typically enter particulate filter 24 via exhaust inlet 26. The exhaust gases will then be passed through housing 25, and in particular passed through filter element 30. Raw exhaust from engine 10 will tend to have a relatively low $NO_2$ to NO ratio. While passing through filter element 30 catalyst 33 will have a tendency to increase the ratio of $NO_2$ to NO in the exhaust gases. $NO_2$ generated as exhaust gases pass through filter element 30 will tend to oxidize particulates accumulated therein. As also described above, by configuring a length, catalyst loading density, etc., of coating 35, increasing the ratio of $NO_2$ to NO above a ratio of about 1:1 may be inhibited. Filtering of the exhaust gases will occur via both of coated section 32 and bare section 34 of filter element 30 during passing the exhaust gases through particulate filter 24. Exhaust gases thusly treated in particulate filter 24 will then be passed via outlet 28 to inlet 42 of downstream segment 21. A reductant, such as urea, may then be injected into the exhaust gases via reductant inlet 46 such that exhaust gases passing into NOx reducing element 40 will carry a reductant with the exhaust gases. NOx in exhaust gases passing through NOx reducing element 40 will tend to be reduced via the injected reductant, or its decomposition products, in the presence of catalyst 45 in downstream segment 21 such that exhaust expelled via outlet 43 will contain NOx at acceptable levels. The NOx reducing reaction in NOx reducing element 40 will tend to take place predominantly via the relatively fast reaction pathway described above.

Many known designs require exhaust system components, such as dedicated diesel oxidation catalyst elements positioned between the engine and particulate filter, for $NO_2$ generation. While it is known to coat particulate filters with catalysts for generating $NO_2$, many such systems do so at the expense of $NO_X$ reducing efficacy. By recognizing that an exhaust system may be designed to provide both sufficient $NO_2$ levels for filter regeneration and optimal $NO_2$ to NO ratios for $NO_X$ reduction, the present disclosure will enable the size and complexity of exhaust system 18 to be reduced over comparable engine systems. A diesel oxidation catalyst upstream filter 24 will typically not be necessary. Moreover, by promoting a relatively faster $NO_X$ reducing reaction pathway, as described above, $NO_X$ reducing efficacy may be improved over earlier systems. Since $NO_X$ reduction may take place relatively more rapidly, volume of downstream segment 21 may also be reduced. In certain instances, engine 10 may be operated such that a relatively greater amount of $NO_X$ is generated, for instance by running engine 10 relatively hotter, since the capacity of exhaust system 18 to successfully reduce $NO_X$ may be relatively better than other systems.

The present description is for illustrative purposes only, and should not be construed to narrow the breadth of the present disclosure in anyway. Thus, those skilled in the art will appreciate that various modifications might be made to the present disclosed embodiments without departing from the full and fair scope and spirit of the present disclosure. For instance, while the foregoing description discusses coating one zone of particulate filter 24 while leaving a second zone of particulate filter 24 bare, the present disclosure is not thereby limited. In other embodiments, filter element 30 might be coated over an entirety of its length L. Other coating characteristics such as catalyst loading density might be linked to the target ratio of $NO_2$ to NO to provide the desired $NO_2$ to NO ratio to downstream segment 21 without departing from the scope of the present disclosure. One example embodiment might include an upstream filter section with relatively high catalyst loading density, and a downstream filter section with relatively low catalyst loading density. The relative lengths of the two sections and/or their relative catalyst loading density could be linked to the target ratio for reducing $NO_X$ as described herein. Other aspects, features and advantages will be apparent upon an examination of the attached drawings and appended claims.

What is claimed is:

1. A method of treating exhaust gases in an exhaust system of an internal combustion engine comprising the steps of:

receiving exhaust gases within an exhaust manifold of the internal combustion engine at an engine-out ratio of $NO_2$ to NO and containing a first amount of NOx;

conveying the exhaust gases from the exhaust manifold to a particulate filter in an upstream segment of the exhaust system via a section of the exhaust system free from catalyst, such that the exhaust gases enter the particulate filter at the engine-out ratio of $NO_2$ to NO;

increasing the ratio of $NO_2$ to NO via a catalyst within the upstream segment from the engine-out ratio toward a target ratio of $NO_2$ to NO for reducing NOx in a NOx reducing element within a downstream segment of the exhaust system;

limiting increasing the ratio of $NO_2$ to NO within the upstream segment via a distribution of the catalyst in the upstream segment, which is linked to the target ratio;

filtering the exhaust gases during each of the increasing step and the limiting step via a first, inlet section of the particulate filter having a coating containing the catalyst, and a second, outlet section which is bare, and wherein a length of the coating defines the distribution of the catalyst;

producing an amount of $NO_2$ sufficient to regenerate the particulate filter, during the step of increasing;

conveying the exhaust gases from the particulate filter to the NOx reducing element at the ratio of $NO_2$ to NO resulting from the steps of increasing and limiting; and reducing NOx in the exhaust gases via the NOx reducing element, such that the NOx is decreased from the first amount to a second amount within the downstream segment.

2. The method of claim 1 wherein the reducing step comprises reducing NOx in the exhaust gases via a plurality of reaction pathways, the method further comprising a step of promoting a faster one of the plurality of reaction pathways via the limiting step.

3. The method of claim 2 wherein the limiting step further comprises inhibiting increasing the ratio of $NO_2$ to NO above a ratio of 1:1.

4. The method of claim 3 wherein the promoting step further comprises promoting the reaction pathway:

$$2\ \text{mol}\ NO_2 + 2\ \text{mol}\ NO + 4\ \text{mol}\ NH_3(ads) \rightarrow 4\ N_2 + 6\ H_2O.$$

5. The method of claim 2 wherein the step of reducing NOx comprises reducing NOx via another catalyst in the downstream segment at least in part via a step of injecting a reductant into the exhaust gases in the downstream segment.

6. The method of claim 5 wherein the step of injecting a reductant into the exhaust gases in the downstream segment comprises injecting urea into the exhaust gases.

* * * * *